United States Patent [19]

Funger

[11] Patent Number: 4,864,729

[45] Date of Patent: Sep. 12, 1989

[54] CUTTING BLADE AND HOLDER THEREFOR

[75] Inventor: Edward A. Funger, Burlington, Canada

[73] Assignee: The PerfecTrim Limited Partnership, Hamilton, Canada

[21] Appl. No.: 211,792

[22] Filed: Jun. 27, 1988

[30] Foreign Application Priority Data

Aug. 26, 1987 [CA] Canada ..... 545462

[51] Int. Cl.[4] ..... B26B 29/00

[52] U.S. Cl. ..... 30/290; 30/293

[58] Field of Search ..... 30/290, 293, 296 R, 30/348, 351, 357, 346.6, 346.61, 294

[56] References Cited

U.S. PATENT DOCUMENTS 1,489,419 4/1924 Beechlyn ..... 30/348

FOREIGN PATENT DOCUMENTS 692152 5/1953 United Kingdom ..... 30/348

*Primary Examiner*—Douglas D. Watts

*Attorney, Agent, or Firm*—Patrick J. Hofbauer

[57] ABSTRACT

A cutting blade and a cutting blade holder are described which, when used together provide exceptional stability to the cutting blade. The cutting blade/blade holder assembly is particularly adapted for use in combination with a carpet cutting device for cutting matched seams in wall-to-wall carpet laying installations.

22 Claims, 2 Drawing Sheets

CUTTING BLADE AND HOLDER THEREFOR

This invention relates generally to the field of hand-held cutting devices, and is more particularly concerned with the provision of an improved cutting blade and blade holder for use with a device for cutting matched seams in overlapped carpet sections. An example of such a carpet cutting device, referred to in the trade as a "double cutter", is shown in my co-pending Canadian patent application Ser. No. 537,507. Use of such a double cutter device during wall-to-wall carpet installation is particularly advantageous where two carpet sections are overlapped for cutting and the respective cut edges of the cut sections are to be matched, with the matched seam created thereby to be hidden, so far as possible, for view.

While the carpet cutting device of my aforementioned Canadian patent application illustrates a cutting blade and blade holder for use therewith, the blade thus illustrated is a well-known so called "utility knife" blade. I have found that considerable improvements in the seam matching obtained thereby may be obtained through the use of a modified cutting blade and blade holder according to the present invention. Moreover, improved results can be expected when an improved blade and blade holder according to the present invention are routinely modified to operatively fit within double cutter carpet cutting devices other than my own.

One of the most serious problems encountered in the use of double cutters for overlapped cutting of carpet sections is that the matched seam created thereby is typically quite visible due to a phenomena generally known as "carpet shaving". That is, because of lateral movement of the cutting blade (i.e. to either side of the line of cutting) during the overlapped cutting operation, the carpet pile immediately adjacent to the cut is often cut shorter than its original length, thus accentuating the visibility of the matched seam. The present invention achieves its superior results over prior art cutting blades and holders for this application by providing an improved cutting blade capable of exhibiting greater stability during the cutting operation, thus reducing the lateral motion of the cutting blade during the cutting operation. The improved cutting blade holder disclosed is especially adapted for use with the cutting blade of the invention to obtain a superior end result.

Carpet installers may, in continuous use of their carpet cutting devices, wear out or otherwise consume several cutting blades in a single day. It is therefore necessary that any cutting blade/cutting blade holder combination designed for use by installers be designed so that the worn out or damaged cutting blades can be quickly interchanged with a fresh cutting blade. It should be borne in mind that design considerations favouring interchangeability typically teach away from stability. The present invention refutes these teachings by providing a cutting blade and blade holder which is exceptionally stable, yet allows for quick and easy exchange of cutting blades.

It is, therefore, an object of the present invention to provide a cutting blade for use with a carpet cutting device for cutting overlapped carpet sections which cutting blade is adapted for improved stability in use.

Moreover, it is a further object of the present invention to provide a cutting blade holder adapted to facilitate use of the novel cutting blade of the invention so as to increase the stability otherwise obtainable thereby.

It is yet a further object of this invention to provide a cutting blade and blade holder that exhibit improved stability in use, yet at the same time provide for quick replacement of spent or damaged cutting blades.

These and other objects of the present invention will become more readily apparent from the detailed inscription of a preferred embodiment which follows.

In one aspect of the invention, an improved cutting blade in accordance with the invention is adapted for use with a carpet cutting device of the type having a planar base plate presenting an upper and a lower surface, at least two generally planar side plates mounted on the base plate so as to protrude downwardly below the lower surface, substantially hollow handle means having a longitudinal axis affixed to the upper surface of the base plate between the two side plates, with the longitudinal axis in angled relation to the upper surface, and a blade holding means adapted to slidingly fit with the handle means so as to rigidly hold the blade means between the two side plates in generally parallel relation to the longitudinal axis with the cutting portion protruding below the lower surface in operative cutting relation to a carpet section to be cut. The blade means comprises a generally planar body of equilateral outline, having two parallel edges of substantially longer length than the remaining two edges, one of which longer parallel edges presents a cutting edge portion and the same or other of which longer parallel edges has affixed to it a stabilizing flange portion extends generally transversely to said generally planar body. In a preferred embodiment, the stabilizing flange portion is positioned on the same parallel edge as the cutting edge portion and extends generally transversely beyond both sides of the generally planar body of the blade means. Moreover, first indexing means are provided on the opposite other parallel edge of the blade means, which first indexing means are adapted to engage a second indexing means on the blade holding means to operatively position the cutting edge portion below the lower surface of the base plate.

In another aspect, the invention comprises a composite cutting blade/blade holder for use with a carpet cutting device of the type having a planar base plate presenting an upper and a lower surface and a substantially hollow handle means defining an internal housing having a longitudinal axis, the handle means being affixed to the upper surface of the base plate with the longitudinal axis in angled relation to the upper surface, the cutting blade/blade holder combination comprising a cutting blade means and a blade holder means. The cutting blade means comprises a generally planar body of quadrilateral outline with two parallel edges of substantially longer length than the remaining two edges, one of which longer parallel edges has positioned thereon a cutting edge portion and a stabilizing flange portion which extends generally transversely to the generally planar body. The cutting blade holder means comprises two spaced apart arm portions extending in generally longitudinal parallel relation so as to define a longitudinal slot therebetween for acceptance of the cutting blade means in longitudinally aligned relation, with the cutting edge portion operatively extending from the slot. An integral channel is formed in the arm portions in transversely intersecting aligned relation to the longitudinal slot and is adapted to receive the stabilizing flange portion of the blade in close-fitting frictional engagement. The holder is further adapted for slidable adjustable mounting within the internal housing of the carpet cutting device so as to allow for variable operative positioning of the cutting edge portion below the lower surface of the base plate. In a preferred embodiment, the cutting blade holder means is of generally square cross-section, and the integral channel is formed in two adjacent outer surfaces of the arm portions, which two surfaces together form a side of the square cross-section. In this manner, the stabilizing flange portion is adapted to contact the complimentary sectioned internal housing of the carpet cutting device upon sliding insertion therein, so as to stabilize the cutting blade means against movement during use.

A preferred embodiment and one variant of the invention will now be described in detail by way of example only, with reference to the accompanying drawings in which:

FIG. 6 is an exploded view of an alternative embodiment of composite cutting blade/blade holder according to the invention; and, FIG. 7 is a perspective view similar to FIG. 6, partly in section.

Figure 1:
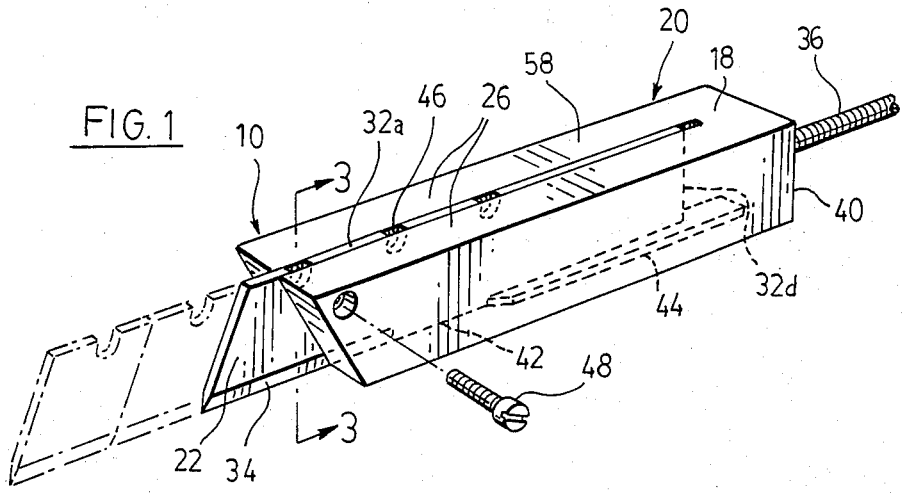
FIG. 1 is a side perspective view of a composite cutting blade/blade holder according to the invention, showing alternate indexed position of the cutting blade in phantom outline.
Figure 2:
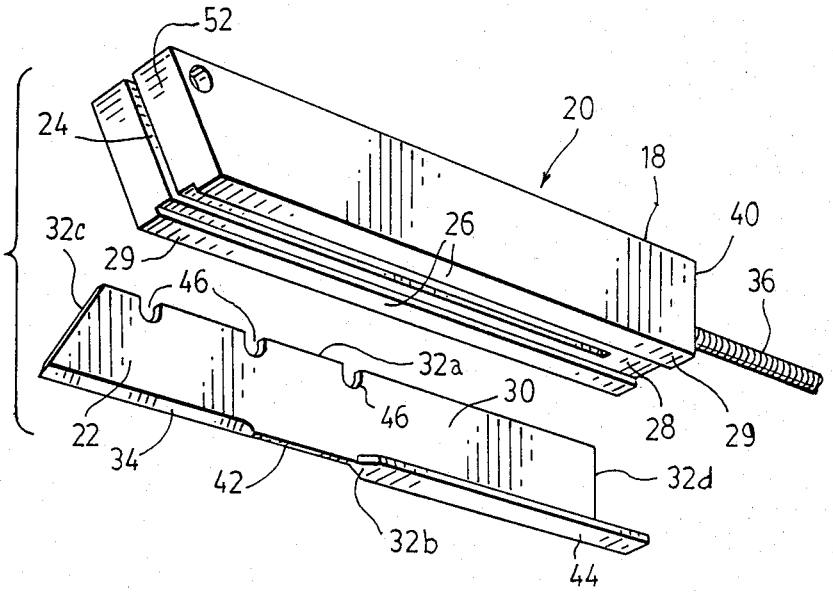
FIG. 2 is an exploded view of the composite cutting blade/blade holder of FIG. 1.
Figure 4:
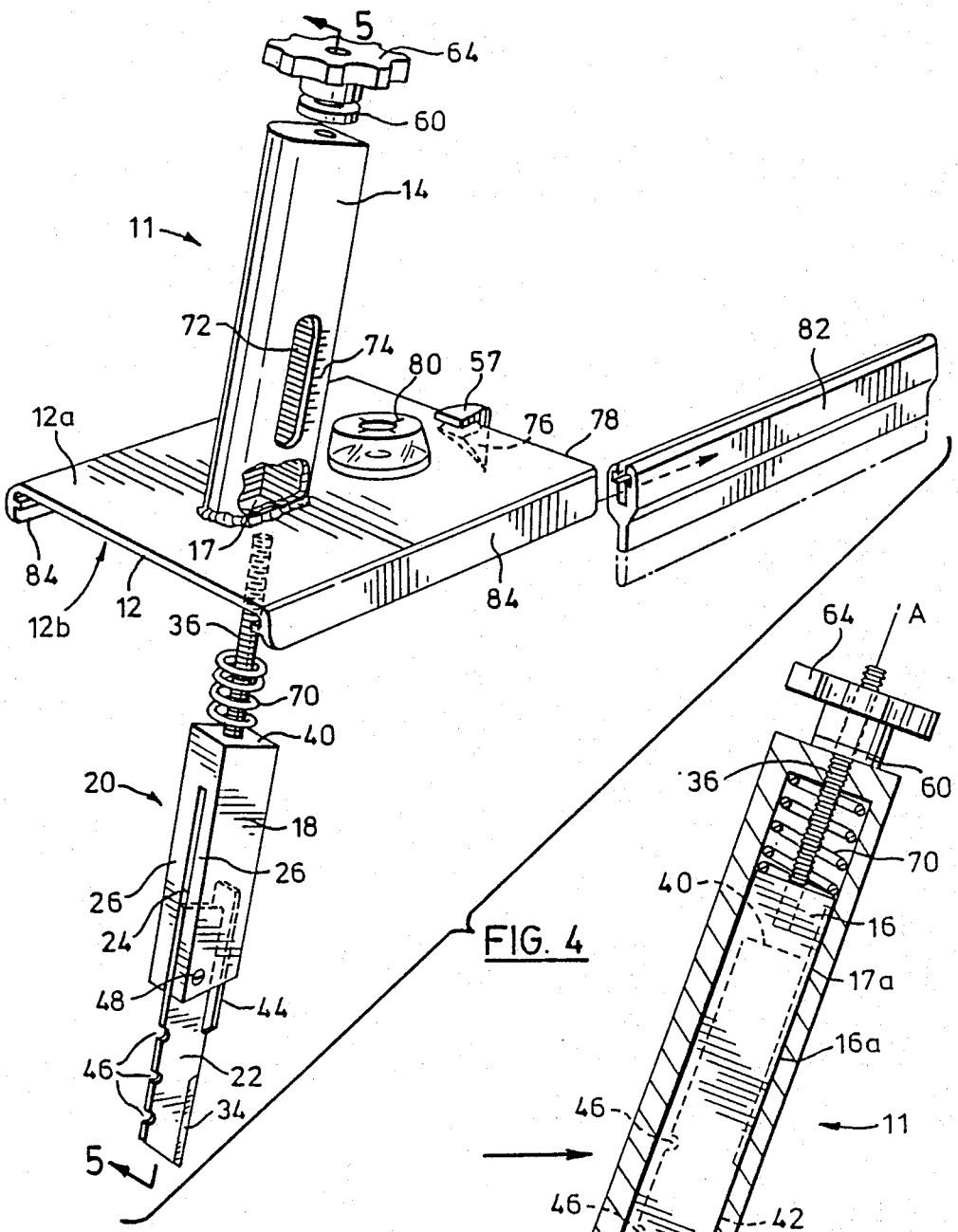
FIG. 4 is a partially exploded view of the composite cutting blade/blade holder of FIGS. 1–3, together with the carpet cutting device with which it is preferably used.
Figure 5:
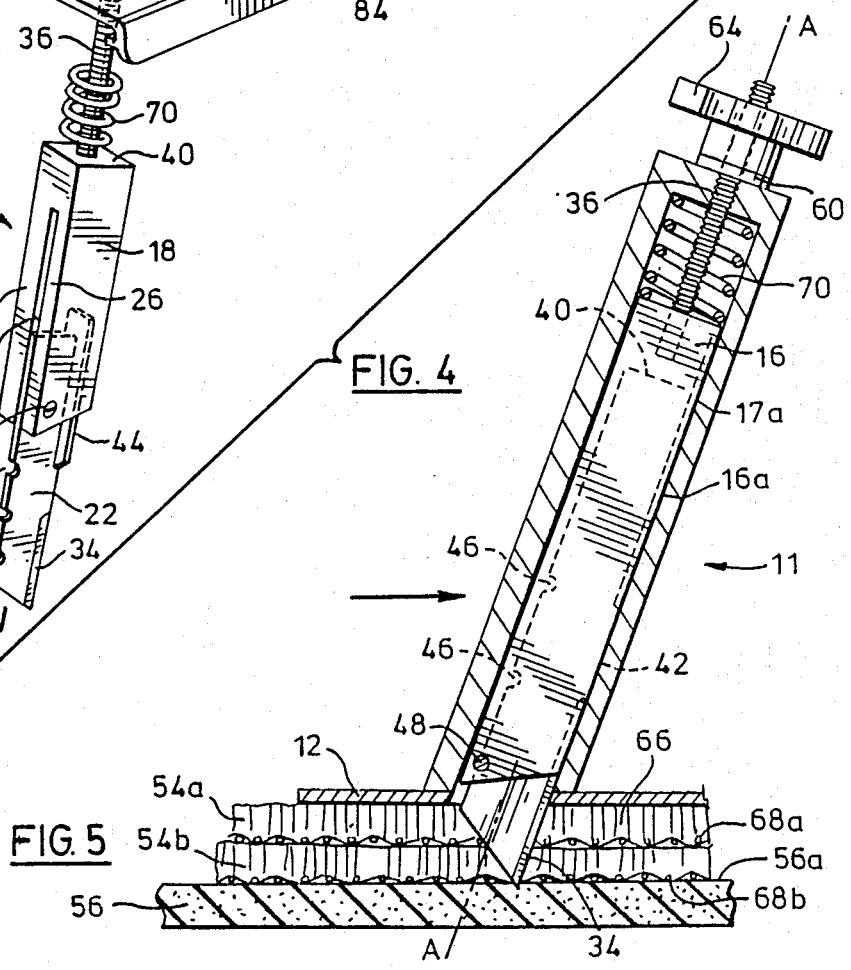
FIG. 5 is a sectional view of the carpet cutting device of FIG. 4, along line 5—5 of FIG. 4.

Referring to the figures, there is shown in FIGS. 1 and 2 a composite cutting blade/blade holder 10 for use with a carpet cutting device 11 of the general type shown in FIGS. 4 and 5. Such a carpet cutting device has a planar base plate 12 presenting an upper 12*a* and a lower 12*b* surface. A substantially hollow handle means 14 is rigidly affixed to the upper surface 12*a* and defines an internal housing 16 having a longitudinal axis, generally indicated by the broken line A—A, seen in FIG. 5. The longitudinal axis A—A is positioned in angled relation to the upper surface 12*a*, the preferred angle being approximately 75° from the horizontal. The internal housing has bottom access opening 17 of generally square outline allowing access into the internal housing 16 through the base plate 12 and is preferably, as shown, of a corresponding substantially square cross-section, so as to accept in a close sliding fit the similarly sectioned body portion 18 of a blade holder 20, in a manner that will be more apparent as this description progresses.

As shown in the Figures, the composite cutting blade/blade holder 10 comprises the blade holder 20 and a cutting blade 22 rigidly and removably held within the blade holder 20 as follows. The body portion 18 of the blade holder 20 bifurcates in a first longitudinal direction so as to form two spaced-apart arm portions 26, 26 extending in generally longitudinal parallel relation so as to define a longitudinal slot 24 therebetween. An intregal channel 28 is formed in adjacent outer surfaces 29 of the arm portions 26, which surfaces 29, 29 together form a side of the complimentary square cross-section of the blade holder 20. The integral channel 28 is formed in the arm portions 26, 26 in aligned relation to the longitudinal slot 24, transversely intersecting the slot 24 along its entire length. For ease of machining, the channel 28 may extend along the full longitudinal length of the blade holder 20.

The body portion 18 of the blade holder 20 presents a threaded bore 38, longitudinally positioned in the body portion 18 in opening relation to a first end face 40 of body portion 18, and adapted to accept in aligned longitudinal relation a correspondingly threaded rod 36 for adjustment of the placement of the blade holder 20 within the internal housing 16 in a manner more fully described below.

Figure 3:
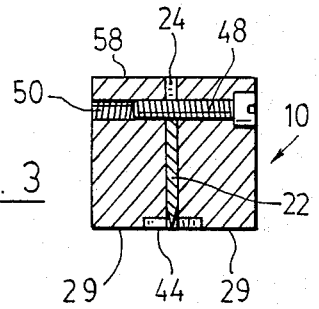
FIG. 3 is a sectional view along the line 3—3 of FIG. 1.

The cutting blade 22 of the invention features a generally planar body 30 of quadrilateral outline, having two parallel edges 32*a* and 32*b* of substantially longer length than the remaining two edges 32*c* and 32*d*. One of the longer parallel edges 32*b* has positioned thereon a cutting edge portion 34 which has been honed to a fine sharpness. An intermediate blunt edge portion 42 abuts the cutting edge portion 34 and at its opposite other longitudinal end abuts a stabilizing flange portion 44, which stabilizing end portion extends generally transversely beyond both sides of the generally planar body 30 of the cutting blade 22. The channel 28 is dimensioned, both in depth and width to accept the stabilizing flange portion 44 in a close sliding fit when the planar body 30 of the cutting blade 20 is slid into the longitudinal slot 24, as seen in FIGS. 1 and 3. In this manner, the outer surface 44*a* is generally flush with the adjacent outer surfaces 29, 29 of the arm portions 26, 26, when so inserted.

First indexing means in the form of three spaced indexing notches 46 are provided on the opposite other parallel edge 32*a* of the cutting blade 22, which indexing notches are adapted to engage a second indexing means in the form of a screw 48, which screw threadingly engages a correspondingly threaded bore 50 which is formed in the arm portions 26 adjacent a second end face 52 of the blade holder 20. With this arrangement, the threaded screw 48 constitutes a detent means for engagement with the indexing slots 46, when the cutting blade 22 is positioned in the longitudinal slot 24, as best seen in FIGS. 1, 3 and 5, so as to selectively position the cutting blade and the cutting edge portion 34 in operative relation to the blade holder 20.

It should be appreciated that the screw 48 could more simply be a rivet or pin traversing the longitudinal slot 24 in the general manner shown, in which case there would be no change in the width of the longitudinal slot 24 during usage of the cutting blade/blade holder. However, in the preferred embodiment illustrated in the Figures, the holder 20 is adapted so that the arm portions 26, 26 can move towards each other adjacent the second end face 52 so as to narrow the longitudinal slot 24. Such narrowing is accomplished by tightening the screw 48 within the bore 50, thus drawing the arm portions 26, 26 together, thereby narrowing the longitudinal slot 24. In this respect, the screw 48 and bore 50 additionally constitute an adjustable clamping means for controlled narrowing of the longitudinal slot 24, thereby providing for controlled clamping of the cutting blade between the arm portions 26. In this manner, additional rigidity of the composite cutting blade/blade holder can be obtained, with the aforementioned desirable result of reduced carpet shaving. However, the provision of such adjustable clamping means is not essential to the invention, as will become apparent from further reading of this disclosure. Where it is provided, the cutting blade 22 can be quickly released from the holder 20, by simple loosening of the screw 48, so as to allow slidable removal of the cutting blade 22 from between the arm portions 26, 26.

The indexing notches 46 are preferably evenly spaced along the opposite other edge 32*a*, so as to allow selective engagement of one of the notches with the screw 48 during placement of the cutting blade into the blade holder 20. The choice of which particular notch 46 to so engage will be dependent upon the desired extension of the cutting edge 34 beyond the second end face 52. This extension is, in turn, dependent upon the thickness of the carpet sections to be cut, as discussed more fully below.

In use, a cutting blade 22 is slid into the longitudinal slot 24, such that a selected one of the indexing notches 46 is aligned so as to register with the shaft portion of the screw 48, thereby allowing the cutting edge 34 to extend a predetermined distance beyond the second end face 52 of the blade holder 20. In this manner, the cutting edge portion 34 is selectively positioned in operative relation to the blade holder 20. The body 30 of cutting blade 22 is dimensioned so that at the point of registration as shown in FIGS. 1, 3 and 5, the stabilizing flange portion 44 lies snugly within the channel 28, with the outer planar surface 44*a* of the stabilizing flange portion in substantially flush alignment with the adjacent outer surfaces 29, 29 of the arm portions 18, as seen in FIG. 3. When so inserted, the screw 48 is tightened by conventional means so as to draw the arm portions 26 toward one another thereby clamping the cutting blade 22 between the arm portions 26, 26. The lateral dimensions of the channel 28 are also proportioned to accept the stabilizing flange portion 44 in a snug, sliding fit, as best seen in FIG. 3. As seen in FIG. 1, the opposite other edge 32*a* of the cutting blade 22 is, in the inserted position shown, substantially flush with the outer surfaces 58 of the arm portions 26.

In FIG. 1 the least extended position of the blade means 22 is shown in solid lines, and the two further extended positions are shown in phantom outline. The stabilizing flange portion 44 overextends the shorter edge 32*d* of the cutting blade 22, so as to provide additional stability against movement of the cutting blade 22 during use, which is particularly advantageous when the blade is positioned in the extended most configuration shown in phantom in FIG. 1.

When the cutting blade 22 is thus assembled in the holder 20, a compression spring 70 is fitted around the threaded rod 36, and the assembly is then slid through the opening 17 into the internal housing 16 in the general manner shown in FIG. 4, so that the threaded rod 36 extends through an opening 62 at the top of the housing 36. A nylon or metal slip washer 60 is place around the rod 36, and an adjustment handle 64 is then threaded onto the free end of the threaded rod 36. The handle 64 may thereafter be rotatably adjusted to operatively position the cutting edge portion 34 at a desired position below the lower surface 12*b* of the base plate 12.

The exact operative adjustment position of the blade holder 20 within the housing 16 will depend to a large extent on the thicknesses of the carpet sections 54*a* and 54*b* being cut. As seen in FIG. 5, an operative orientation of the holder 20 and the cutting blade 22 is where the cutting edge portion 34 is able to penetrate completely through the uppermost carpet section 54*a* and substantially through the lowermost carpet section 54*b* and may, to a minor extent, score the upper surface 56*a* of the underpad 56. In this configuration, the blunted blade portion 42 is preferably aligned with the pile 66 of the upper carpet section 54*a* so as to minimize cutting or shaving of the pile, while the cutting edge portion 34 of the cutting blade 22 is in aligned cutting relation with the fiber backing 68*a* of the uppermost carpet section 54*a*.

When the handle 64 is tightened, it draws the blade holder 20 upwardly into the housing 16, so as to retract the holder 20 and the cutting blade 22 relative the lower surface 12*b* of the base plate 12. In this retracted mode, the cutting device 11 is able to accommodate carpet sections of relatively thin section while minimizing scoring of the underpad 56. While it is desirable for maximum stability of the cutting blade 22 to insert the cutting blade 22 into the blade holder 20 so as to engage the indexing notch 46 closest to the tip of the cutting blade 22, it may be necessary, particularly where the carpet sections 54*a* and 54*b* are relatively thick, to engage the intermediate indexing notch 46, or, with unusually thick carpet sections, the indexing notch 46 furthest from the cutting blade tip. The indexing notches 46, 46, 46 and the screw 48 thus provide for selective positioning of the cutting edge portion 34 in operative relation to the blade holding means 20.

To facilitate measured sliding adjustment of the cutting blade/blade holder 10 within the housing 16 of the handle means 14, there is provided on one side of the handle means a window 72 through which the positioning of the first end face 40 of the blade holder 20 can be seen. A position indication scale 74 can be engraved or marked on the outside of the handle means 14 to facilitate such placement.

It will be appreciated from FIG. 5, that, in use, the stabilizing flange portion 44 is held rigidly between a side wall 17*a* and the walls of the channel 28, so as to rigidly hold the cutting blade 22 between the arm portions 26 in a plane transverse to the plane of the stabilizing flange 44. Moreover, lateral movement of the cutting blade from side to side is minimized by the rigidity added to the planar body 30 of the cutting blade 22 and by the anchoring of the stabilizing flange portion 44 in the channel 28, when the carpet cutting device 11 is moved in the operative cutting direction indicated by the arrow of FIG. 5.

It is also preferable to provide cutting indicator means 57 on the base plate 12, which means indicate the operative plane of the cutting blade 22. As shown, such cutting indicator means is comprised of the leading edge of a generally triangular-shaped wedge 76 mounted on a leading edge 78 of the base plate 12. The triangular shaped wedge 76 is so positioned that the leading edge thereof is aligned with the operative plane of the cutting edge portion 34, such that, during use, the installer may align the forward edge with a line or other marking on the carpet sections 54*a*, 54*b*. The cutting indicator means 57 may, in other embodiments, more simply constitute a line on the upper surface 12*a* of the base plate 12, the line being similarly aligned with the operative plane of the cutting edge portion 34.

The preferred carpet cutting device illustrated additionally comprises a means 77 for separating the pile of the carpet sections 54*a*, 54*b* prior to cutting, this means consisting of the triangular shaped wedge 76 previously discussed. Details of this structure and its function are given in my Canadian patent application Ser. No. 537,507.

As described in my Canadian patent application Ser. No. 537,507, it is also desirable to have attached to the upper surface 12*a* of the base plate 12 a level indicator 80, and to employ one or more adjustment sleeves 82 slidably engageable with the generally planar side plates 84 mounted on the base plate 12 so as to orientate the base plate 12 in level operative positioning over the two overlapped carpet sections 54*a* and 54*b*, or in non-level operative positioning thereover, as the case may require, so as to obtain "exactly even", "thick" or "thin" matches of the cut carpet sections. The terms "thick", "thin" and "exactly even" are used herein as generally understood in the art, and as defined in my aforementioned Canadian patent application Ser. No. 537,507.

Once the carpet sections are overlapped in the manner shown in FIG. 5, the cutting indicator means 57 is aligned with the desired line of cutting and the installer grasps the handle means 16 and pushes forwardly and slightly downwardly on the handle member 14 so as to move the carpet cutting device 11 in the direction of the solid arrow of FIG. 5, all the while keeping the cutting indicator means 57 in alignment with the desired cutting line. The cutting line may be either marked on the uppermost carpet section 54*a*, or may be an imaginery line.

Once the sections 54*a* and 54*b* are cut in this general manner, they are simply placed into relatively flush, matched, orientation and may, as is the practice, be folded over in unison for the application of seam-tape to the underside of the fibre backings 68*a* and 68*b*.

Referring to FIGS. 6 and 7, there will be seen an alternative form of composite cutting blade/blade holder (according to the invention), designated by the general reference numeral 90. Unlike the previous embodiment described in relation to FIGS. 1–5, the body portion 91 of the blade holder 92 is of composite construction comprising two complementary halves 91*a* and 91*b*. The two halves 91*a* and 91*b* are fitted together as seen in FIGS. 6 and 7 to form the blade holder 92. The cutting blade 93 lies in a slot 98 formed by the two segments 91*a*, 91*b* and, together with the two segments, forms the cutting blade/blade holder combination 90. The two segments 91*a*, 91*b* are indexed to one another by means of a locating pin 94 protruding from one end of segment 91*a* and by means of indexed apertures 95*a* and 95*b*. The apertures 95*a* are located in the opposite other end of the segment 91*a*, and are threaded to receive machine screws 96, which are inserted one each through respective apertures 95*b*. The locating pin 94 indexes with an aligned indexing aperture 97 located in the segment 91*b*.

To assemble the blade holder 92, the two segments 91*a*, 91*b* are brought towards one another, as indicated in FIG. 6, so as to align the locating pin 94 with the indexing aperture 97 and so as to align the threaded apertures 95*a*, 95*a* with the corresponding apertures 95*b*, 95*b*. Thereafter, the machine screws 96 are threaded through the apertures 95*b*, 95*b* into the threaded apertures 95*a*, 95*a*, and tightened up to the configuration shown in FIG. 7. The cutting blade 93 is then inserted at a downward angle through the slot 98 as shown in phantom outline in FIG. 7. A selected one of the indexing notches 98, 99, is then caused to be engaged by the locating pin 94, and the blade 93 is then pivoted in a generally clockwise manner (as indicated by arrows A and B in FIG. 7) about the locating pin 94 so as to locate the cutting blade 93 in the fixed operative position shown in solid lines in FIG. 7.

It will be seen from FIGS. 6 and 7 that the two segments 91*a*, 91*b* together define a channel 99 in which a stabilizing flange portion 100 of the cutting blade 93 rests in the operable configuration shown in solid outline in FIG. 7. It will be noted, in contrast to the embodiment of FIGS. 1–5, that the stabilizing flange portion 100 is located on the opposite other longer parallel edge 101 from the cutting blade 93. More over, the stabilizing flange portion 100 extends in only one generally perpendicular direction from the generally planar body portion of the cutting blade 93. It should also be noted that the cutting edge 102 extends along the entire length of the longer parallel edge of the cutting blade 93 opposite to the stabilizing flange portion 100. Both of these changes (i.e. repositioning of the stabilizing flange portion 100 and lengthening of the cutting edge 102) have been carried out in order to facilitate manufacturing of the cutting blade 93. That is, the stabilizing flange portion 100 is fabricated by a simple bending of an otherwise flat tab of the blade 93 so as to form the stabilizing portion 100 in a plane generally perpendicular to the plane of the cutting blade 93. The repositioning of the stabilizing flange portion 100 to the edge of the blade 93 opposite to the cutting edge 102 significantly simplifies the discontinuous honing procedure that would otherwise be necessary to produce the cutting blade 22 shown in FIGS. 1–5, thus significantly reducing production costs.

Each of the segments 91*a*, 91*b* also includes a threaded half-bore 103*a*, 103*b*, respectively, which half-bores together define a threaded socket for acceptance of a threaded rod (not shown) generally similar to the threaded rod 36 shown in FIGS. 1–5. In this manner, the blade holder 92 shown in FIGS. 6 and 7 may be fitted into the handle means 14 of the carpet cutting device 11 shown in FIGS. 1 and 5, for use in the cutting of carpets as previously described.

It will be appreciated that the cutting blade 93, when assembled in the holder 92 as shown in solid outline in FIG. 7, is free, when used in conjuction with the cutting device 11 as shown in FIGS. 4 and 5, to pivot in a direction which is opposite to arrows A and B of FIG. 7. However, it will be appreciated that such pivoting is only possible when the device 11 is pushed or pulled by the user in the rearward direction (i.e. in reverse direction to the horizontal arrow shown in FIG. 5). This will not, of course, effect cutting performance. That is, when the device 11, with the cutting blade/blade holder combination 90 inserted therein, is pushed in the direction of the horizontal arrow of FIG. 5, such motion will cause the cutting blade 93 to be pivoted about the locating pin 94 in the direction of arrows A, B of FIG. 7, such that the stabilizing flange portion 100 is pressed into restraining contact with shoulder 104 of segment 91*a*. This action will stabilize the cutting blade 93 in the same general manner accomplished by stabilizing flange 44 in relation to cutting blade 22 of the preferred embodiment shown in FIGS. 1–5. Thus, there is shown in FIGS. 6 and 7 a novel cutting blade/blade holder combination 92 exhibiting all of the desirable characteristics of the preferred embodiment shown in FIGS. 1–5, while at the same time employing a cutting blade 93 which is significantly easier to manufacture.

While but a single embodiment of the invention has been described herein in detail, it will be appreciated by those skilled in the art that non-inventive changes may be made to the cutting blade 22 and blade holder 20 without departing from the spirit and scope of the invention. For example, as previously mentioned, the screw 48 and bore 50, or other equivalent clamping means, may be entirely omitted from the device while still obtaining improved results over the prior art. That is, the screw 48 may be replaced by other detent means comprising a second indexing means, which detent means would not have a clamping function. In such instance, the cutting blade 22 is still rigidly held in the blade holder 22 by the stabilizing flange portion 44, the internal housing wall 17*a* and the correspondingly profiled channel 28, against movement in planes either parallel to or transverse to the plane of the body 30 of the cutting blade 22, and is held against longitudinal sliding of the cutting blade by such detent means interacting with the first indexing means 46 on the cutting blade 22. Moreover, it is specifically envisioned that, at least where clamping means of the general nature illustrated are employed, that the cutting blade/blade holder 10 could be used, absent the threaded rod 36, as a substitute for a standard utility knife and would, in such configuration, be advantageously used in applications requiring increased blade stability. In such applications, it may be desirable to extend the body portion 18 of the holder 20 and to change its outer contours to enhance gripping by a user.

It will also be obvious to those skilled in the art that the cutting blade could be re-designed with little effort so that the cutting edge portion 34 was re-positioned on the longer parallel edge opposite to the stabilizing flange portion. Such a change is specifically envisioned by the present invention and covered by the appended claims.

Additionally, while the various proportions and dimensions of the cutting blade 22 and blade holder 20 given in the detailed description of the preferred embodiment illustrated and set out in the appended claims have been found to be particularly useful, other dimensions will exhibit similar improved utility over the prior art. Moreover, the cross-section of the holder 20 and internal housing 16 need not be substantially square as illustrated but, rather, may be rectangular, ovoid or of other shape.

I claim:

1. A cutting blade having a cutting edge portion for use with a carpet cutting device having a planar base plate presenting an upper and a lower surface, at least two generally planar side plates mounted on the base plate so as to protrude downwardly below the lower surface, a substantially hollow handle means having a longitudinal axis affixed to the upper surface of the base plate between the two side plates with said longitudinal axis in angled relation to the upper surface, and a blade holding means adapted to slidingly fit within the handle means so as to rigidly hold the blade means between the two side plates in generally parallel relation to said longitudinal axis with a cutting edge portion protruding below said lower surface in operative cutting relation to a carpet section, the cutting blade comprising:

a generally planar body of quadrilateral outline, having two parallel edges of substantially longer length than the remaining two edges, one of which longer parallel edges presents the cutting edge portion and that same or other of which longer parallel edges has affixed to it a thin stabilizing, generally planar flange portion having two mutually co-extensive and opposed, parallel surfaces which extend generally transversely to said generally planar body, said flange portion being adapted to engage a corresponding surface of said blade holding means in supported relation therewith.

2. A cutting blade having a cutting edge portion for use with a carpet cutting device having a planar base plate presenting an upper and a lower surface, at least two generally planar side plates mounted on the base plate so as to protrude downwardly below the lower surface, a substantially hollow handle means having a longitudinal axis affixed to the upper surface of the base plate between the two side plates with said longitudinal axis in angled relation to the upper surface, and a blade holding means adapted to slidingly fit within the handle means so as to rigidly hold the blade means between the two side plates in generally parallel relation to said longitudinal axis with a cutting edge portion protruding below said lower surface in operative cutting relation to a carpet section, the cutting blade comprising:

a generally planar body of quadrilateral outline, having two parallel edges of substantially longer length than the remaining two edges, one of which longer parallel edges presents the cutting edge portion and that same or other of which longer parallel edges has affixed to it a stabilizing, flange portion which extends generally transversely to said generally planar body wherein first indexing means are provided on the opposite other parallel edge, which first indexing means are adapted to engage a second indexing means on the blade holding means so as to selectively position the cutting edge portion in operative relation to the blade holding means.

3. The cutting blade of claim 2, wherein the stabilizing flange portion is positioned on the same said one parallel edge as the cutting portion.

4. The cutting blade of claim 2, wherein the stabilizing flange portion extends generally transversly beyond both sides of the generally planar body.

5. The cutting blade of claim 2, wherein said first indexing means comprises a spaced plurality of index notches adapted to interact in serial fashion with said second indexing means so as to selectively position the cutting edge portion in operative relation to the blade holding means.

6. The cutting blade of claim 5, wherein said second indexing means comprise a detent means.

7. The cutting blade of claim 6, wherein the stabilizing flange portion is spaced from the cutting edge portion along said one edge by an intermediate blunt edge portion and the stabilizing flange portion overextends an adjoining one of the shorter two edges of the body.

8. The cutting blade of claim 7, wherein the overall length of said one parallel edge is approximately 4.0″ and the stabilizing flange portion overextends said adjoining one shorter edge by approximately 0.5″.

9. The cutting blade of claim 8, wherein the overall length of the stabilizing flange portion is approximately 2¼″.

10. The cutting blade of claim 9, wherein said one adjoining shorter edge is oriented substantially perpendicular to said one parallel edge and is approximately 0.75″ in overall length.

11. The cutting blade of claim 8, wherein the overall length of the opposite other of the parallel edges is approximately 3.5″.

12. A composite cutting blade/blade holder for use with a carpet cutting device having a planar base plate presenting an upper and a lower surface, and a substantially hollow handle means defining an internal housing having a longitudinal axis, the handle means being affixed to the upper surface of the base plate with said longitudinal axis in angled relation to the upper surface, said cutting blade/blade holder comprising:

a cutting blade having a generally planar body of quadrilateral outline, with two parallel edges of substantially longer length than the remaining two edges, one of which longer parallel edges has positioned thereon the cutting edge portion and a stabilizing flange portion which extends generally transversly to said generally planar body; and, a blade holder having two spaced apart arm portions extending in generally longitudinal parallel relation so as to define a longitudinal slot therebetween for acceptance of the cutting blade means in longitudinally aligned relation, with the cutting edge portion operatively protruding from the slot, and an integral channel formed in the arm portions in transversely intersecting, aligned relation to the longitudinal slot and being adapted to receive said stabilizing flange portion of the blade in close-fitting frictional engagement, the holder being adapted for slidably adjustable mounting within the internal housing so as to allow for variable operative positioning of the cutting edge portion below the lower surface of the base plate.

13. A cutting blade/blade holder according to claim 12, wherein the stabilizing flange portion extends generally transversly beyond both sides of the generally planar body of the cutting blade.

14. A cutting blade/blade holder according to claim 13, wherein first indexing means are provided on the opposite other edge of the blade means and corresponding second indexing means are provided on the arm portions to operatively engage the first indexing means so as to operatively position the cutting blade within the cutting blade holder.

15. A cutting blade/blade holder according to claim 14, wherein the cutting blade holder is of generally square cross-section and wherein the integral channel is formed in adjacent outer surfaces of the arm portions, which surfaces together form a side of said cross-section, such that the stabilizing flange portion is adapted to contact the complimentary sectioned internal housing upon sliding insertion therein, so as to stabilized the cutting blade against movement during use.

16. A cutting blade/blade holder according to claim 15, wherein the arm portions are adapted for movement towards each other to narrow the longitudinal slot and wherein adjustable clamping means are provided on the arm portions for controlled narrowing of said slot, thereby providing for controlled clamping of the cutting blade between the arm portions.

17. The cutting blade of claim 2, wherein the stabilizing flange portion is positioned on the other of said longer parallel edges from the cutting edge portion.

18. The cutting blade of claim 17, wherein the stabilizing flange portion extends generally transversely beyond one side only of the generally planar body.

19. A composite cutting blade/blade holder for use with a carpet cutting device having a planar base plate presenting an upper and a lower surface, and a substantially hollow handle means defining an internal housing having a longitudinal axis, a handle means being affixed to the upper surface of the base plate with said longitudinal axis in angled relation to the upper surface, said cutting blade/blade holder comprising:

a cutting blade having a generally planar body of generally quadrilateral outline, with two parallel edges of substantially longer length than the remaining two edges, one of which longer parallel edges has positioned thereon the cutting edge portion and the opposite other of which longer parallel edges has positioned thereon a stabilizing flange portion which extends generally transversely to said generally planar body;

a blade holder having two detachable segments extending in generally longitudinal parallel relation to one another so as to define a longitudinal slot therebetween for acceptance of the cutting blade means in longitudinally aligned relation, with the cutting edge portion operatively protruding from slot; and, an integral channel formed by the segments in transversely intersecting, aligned relation to the longitudinal slot, and being adapted to receive said stabilizing flange portion of the blade in close-fitting frictional engagement, the holder being adapted for slidably adjustable mounting within the internal housing so as to allow for variable operative positioning of the cutting edge portion below the lower surface of the base plate.

20. A cutting blade/blade holder according to claim 19, wherein the stabilizing flange portion extends generally transversely beyond one slide only of the generally planar body of the cutting blade.

21. A cutting blade/blade holder according to claim 20, wherein first indexing means are provided on the opposite other edge of the blade means and corresponding second indexing means are provided on the segments to operatively engage the first indexing means so as to operatively position the cutting blade in relation to the cutting blade holder.

22. The cutting blade of claim 21, wherein first indexing means are provided on the opposite other parallel edge, which first indexing means are adapted to engage a second indexing means on the blade holding means so as to selective position the cutting edge portion in operative relation to the blade holding means.

* * * * *